US009945169B2

(12) United States Patent
Kruedener et al.

(10) Patent No.: US 9,945,169 B2
(45) Date of Patent: Apr. 17, 2018

(54) HINGE FOR A MOVABLE FURNITURE PART FASTENED TO A BODY OF AN ITEM OF FURNITURE

(71) Applicant: GRASS GMBH & CO. KG, Reinheim (DE)

(72) Inventors: Boris Kruedener, Kleinostheim (DE); Markus Herper, Muehltal (DE); Sebastian Lautenschlaeger, Seeheim-Jugenheim (DE)

(73) Assignee: Grass GmbH & Co. KG, Reinheim (DE)

( * ) Notice: Subject to any disclaimer, the term of this patent is extended or adjusted under 35 U.S.C. 154(b) by 0 days.

(21) Appl. No.: 15/283,542

(22) Filed: Oct. 3, 2016

(65) Prior Publication Data

US 2017/0096849 A1 Apr. 6, 2017

(30) Foreign Application Priority Data

Oct. 5, 2015 (DE) ..... 20 2015 105 233 U

(51) Int. Cl.
*E05F 1/08* (2006.01)
*E05F 5/00* (2017.01)
(Continued)

(52) U.S. Cl.
CPC ..... *E05F 5/006* (2013.01); *E05D 3/12* (2013.01); *E05D 5/0276* (2013.01); *E05F 5/08* (2013.01); *E05F 5/10* (2013.01); *E05Y 2900/20* (2013.01)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 4,660,251 A * 4/1987 Watabe ..... E05D 7/04 16/289
7,065,833 B2 * 6/2006 Kropf ..... E05D 3/142 16/286
(Continued)

FOREIGN PATENT DOCUMENTS

DE 36 16 028 C2 3/1993
DE 202 21 066 U1 12/2004
(Continued)

OTHER PUBLICATIONS

German Search Report (Application No. 20 2015 105 233.2) dated Sep. 14, 2106.
(Continued)

*Primary Examiner* — Chuck Mah
(74) *Attorney, Agent, or Firm* — Burr & Brown, PLLC

(57) ABSTRACT

A hinge, for a movable furniture part, in particular, a door or flap, that is fastened to a body of an item of furniture, wherein the hinge has a first attachment element, which is connected pivotably to a second attachment element via a joint mechanism, wherein the joint mechanism comprises at least one articulated lever, which is mounted pivotably on the first attachment element via a first bearing element. The hinge is characterized in that the articulated lever is arranged in a rotationally fixed manner on the first bearing element.

11 Claims, 8 Drawing Sheets

(51) Int. Cl.

| | |
|---|---|
| ***E05D 3/12*** | (2006.01) |
| ***E05D 5/02*** | (2006.01) |
| ***E05F 5/08*** | (2006.01) |
| ***E05F 5/10*** | (2006.01) |

(58) Field of Classification Search
CPC ..... E05Y 2201/21; E05F 5/006; E05F 5/02; E05F 5/027; E05F 5/08; E05F 5/10; E05D 11/1021; E05D 11/1042; E05D 11/105; E05D 11/1064; E05D 5/0276; E05D 7/04; E05D 7/0407; E05D 7/125; E05D 3/12; E05D 3/142; Y10T 16/5383; Y10T 16/304; Y10T 16/54029
See application file for complete search history.

(56) References Cited

U.S. PATENT DOCUMENTS 7,500,287 B2 * 3/2009 Brustle ..... E05F 1/1075 16/286
7,810,212 B2 * 10/2010 Salice ..... E05D 11/1021 16/286
8,091,176 B2 * 1/2012 Salice ..... E05D 11/087 16/286
2003/0172920 A1 * 9/2003 Gronbach ..... E05D 7/12 126/197
2004/0239213 A1 * 12/2004 Hirtsiefer ..... E05D 15/262 312/109
2008/0276426 A1 * 11/2008 Salice ..... E05D 11/1021 16/333
2011/0083299 A1 * 4/2011 Krudener ..... E05D 7/0407 16/319
2012/0174338 A1 * 7/2012 Wu ..... E05F 5/006 16/297
2015/0330128 A1 * 11/2015 Ng ..... E05D 3/16 16/65
2015/0351539 A1 * 12/2015 Baldreich ..... E05D 11/1064 312/319.2
2016/0138319 A1 * 5/2016 Wu ..... E05D 3/02 16/50

FOREIGN PATENT DOCUMENTS

DE 20 2008 005 004 U1 7/2008
DE 10 2007 047 287 A1 11/2008

OTHER PUBLICATIONS

European Search Report, European Application No. 16191410.6, dated Feb. 2, 2017 (7 pages).

* cited by examiner

HINGE FOR A MOVABLE FURNITURE PART FASTENED TO A BODY OF AN ITEM OF FURNITURE

This application claims the benefit under 35 USC § 119(a)-(d) of German Application No. 20 2015 105 233.2 filed Oct. 5, 2015, the entirety of which is incorporated herein by reference.

FIELD OF THE INVENTION

The present invention relates to a hinge for a movable furniture part that is fastened to a body of an item of furniture, and an item of furniture comprising such a hinge.

BACKGROUND OF THE INVENTION

A known hinge for a movable furniture part that is fastened to a body of an item of furniture comprises a hinge arm which is connected pivotably to a hinge cup via a joint mechanism. The hinge arm is fastened, for example, to a furniture body and the hinge cup is fastened to a furniture door. The joint mechanism comprises a four-bar linkage, and, during the closure of the furniture door, the four-bar linkage couples to a damping element which is formed on the hinge cup. In this way, a movement of the furniture door is damped in the process of closing the furniture door.

A disadvantage is that the damping element, in the assembled state, is arranged protruding from the surface of the furniture body on the hinge.

SUMMARY OF THE INVENTION

The object of the present invention is to improve a hinge for a movable furniture part fastened to a body of an item of furniture.

The present invention proceeds from a hinge for a movable furniture part, in particular, a door or flap, that is fastened to a body of an item of furniture. The hinge has a first attachment element, which is connected pivotably to a second attachment element via a joint mechanism, wherein the joint mechanism comprises at least one articulated lever, which is mounted pivotably on the first attachment element via a first bearing element.

When the hinge is in the assembled state on the item of furniture, the first attachment element is advantageously fastened to the movable furniture part, e.g. a door, and the second attachment element is fastened to the furniture body. A closing movement of the movable furniture part from an open position to a closed position on the furniture body thus corresponds, for example, to a closing movement of the hinge.

The essential aspect of the present invention is now considered to be that the articulated lever is arranged in a rotationally fixed manner on the first bearing element.

In this way, a pivoting movement of the articulated lever can be converted or transformed into a rotation movement of the bearing element.

Preferably, the joint mechanism comprises a first articulated lever and a second articulated lever. The joint mechanism can be configured, in particular, as a four-bar linkage.

A first articulated lever can be connected rigidly to the first bearing element. Advantageously, the first articulated lever is plugged, bonded, screwed, riveted and/or welded onto the first bearing element.

In an advantageous variant of the present invention, the first bearing element has an eccentric member, which acts on a damping element. In this way, a rotation movement of the joint mechanism of the hinge can be converted into an, in particular, linear damping movement of the hinge. In particular, a rotation movement of the bearing element can be converted into an, in particular, linear damping movement of the damping element. The damping movement of the damping element takes place, for example, along an axis of the damping element.

Advantageously, the damping element is arranged rigidly, for example, plugged, screwed and/or riveted, on an outer face of a side wall of the housing, in particular, in a fixed position relative to a housing of the first attachment element. The first attachment element is configured as a hinge cup, for example.

It is also conceivable that the damping element is arranged in the interior of the housing of the first attachment element, for example, on an inner face of the side wall of the hinge cup.

It is moreover proposed that the eccentric member is arranged in a rotationally fixed manner on the first bearing element. This has the advantage that a rotation of the bearing element is converted directly into a rotation of the eccentric member. For example, the eccentric member is bonded, screwed, riveted and/or welded onto the first bearing element.

Furthermore, it is advantageous that the first attachment element comprises a panel element, and the damping element, in the assembled state of the hinge on the item of furniture, is formed on the first attachment element on the side face of the panel element facing toward the item of furniture.

The first attachment element comprises, for example, a hinge cup and the panel element. By way of the panel element, the first attachment element can be secured on the item of furniture, for example, on the flap or door. For example, the panel element is designed in several parts.

Advantageously, the damping element is arranged on the panel element in such a way that, in the assembled state of the hinge or of the first attachment element on the item of furniture, the damping element is not visible to a person using the item of furniture.

For example, the damping element is arranged on the outer face of the side wall of the hinge cup in such a way that, in the assembled state of the hinge on the item of furniture, the damping element is concealed by the panel element and is not visible to a person using the item of furniture. The reason for this is, for example, that, looking at the item of furniture from above, the panel element of the hinge fitted on the item of furniture protrudes past the contour of the damping element.

It also proves advantageous that the first bearing element is configured as a shaft. For example, the first bearing element is mounted so as to be movable on the first attachment element, in particular, so as to be rotatable about its longitudinal axis, for example. An articulated lever connected to the bearing element is thus mounted pivotably, and an eccentric member connected to the bearing element is thus mounted rotatably. In this way, a torque of the articulated lever can advantageously be transmitted via the shaft to the eccentric member.

An advantageous embodiment of the hinge is characterized in that a damping element and/or a bearing element and/or an eccentric member can be retrofitted on the hinge. In this way, the function of the hinge can be extended according to requirements.

The hinge can be configured in such a way that a damping element and/or a bearing element and/or an eccentric member is arranged exchangeably or releasably. Advantageously, a hinge function of the hinge is provided without an arranged damping element and/or an arranged eccentric member.

In an advantageous variant of the hinge, the eccentric member is arranged on the first bearing element on an outer face of the housing of the hinge, e.g. an outer face of a hinge cup. In this way, the eccentric member can act directly on the damping element. For example, the eccentric member is rigidly connected to the damping element.

It is also advantageous that the eccentric member has a guide member.

Advantageously, the guide member is configured as an outer track or slotted guide. For example, the guide member is arranged on a side surface or on an outer edge of the eccentric member in such a way that the eccentric member acts on the damping element, particularly during a rotation movement of the bearing element.

In an advantageous variant of the eccentric element, the guide member, in particular, the outer track or the slotted guide, executes an eccentric movement. The outer contour of the eccentric member, viewed from the side, can have a droplet shape, and the guide member can be configured as a partial area of the droplet contour. In this way, an action of the eccentric member on the damping element, for example, in the course of a closing movement, can be strengthened.

According to an advantageous modification of the present invention, a guide element is formed on the damping element.

The guide element is preferably configured in such a way that the guide member and/or the eccentric member and/or the bearing element are coupled to the guide element such that a closing movement of the hinge, in particular, of the joint mechanism of the hinge, is damped, or, in the assembled state of the hinge on the item of furniture, a closing movement of the movable furniture part is damped.

It is also conceivable that the damping element and the eccentric member are connected to each other via the guide member and/or the guide element, in particular, rigidly connected to each other.

For example, a slotted guide and/or a contour is formed on the guide element.

The eccentric member and/or the guide member cooperate with the slotted guide and/or the contour of the guide element, for example, in such a way that the rotation movement of the bearing element and/or of the eccentric member is converted into a linear movement of the guide element. It is thus possible to achieve a damping action of the damping element during a closing movement of the hinge and/or, in the assembled state of the hinge on the item of furniture, during a closing movement of the movable furniture part.

It is also advantageous that a control member is formed on the eccentric member.

The control member is formed on the eccentric member and/or on the bearing element, for example, in such a way that it acts eccentrically on the damping element. Advantageously, it is an eccentrically arranged pin which moves in the guide element arranged on the damping element, for example, a slotted guide of the guide element.

It is further proposed that the joint mechanism comprises a second bearing element, and a further eccentric member is formed on the second bearing element.

Preferably, the second bearing element is formed on the second attachment element, and the first articulated lever is connected pivotably to the second attachment element via the second bearing element. Moreover, a further damping element can be present on the second attachment element and can advantageously cooperate with the further eccentric member of the second bearing element. This has the advantage that both a closing movement and also an opening movement of the hinge is damped and/or, in the assembled state of the hinge on the item of furniture, a closing and opening movement of the movable furniture part is damped.

It also proves advantageous that the second bearing element is arranged on the first attachment element.

For example, the second bearing element is mounted movably as a shaft on the first attachment element; alternatively, the second bearing element can also be configured as a stationary joint axle and/or bearing bolt and/or bearing pin.

In another advantageous embodiment of the hinge, the second articulated lever of the joint mechanism is coupled to the second bearing element, in particular, rigidly connected thereto.

By means of a differently configured rotation movement of the first bearing element in relation to a rotation movement of the second bearing element during a closing or opening movement of the hinge and/or an advantageous configuration of a single eccentric member on the first and on the second bearing element, the single eccentric member can advantageously execute an eccentrically acting movement and couple to a damping element in such a way that a movement of the hinge is damped and/or, in the assembled state of the hinge on the item of furniture, a movement of the movable furniture part is damped, in particular, a closing movement of the hinge and/or of the movable furniture part.

BRIEF DESCRIPTION OF THE DRAWINGS

Further features and advantages of the present invention are explained in more detail on the basis of illustrative embodiments depicted schematically in the figures.

DETAILED DESCRIPTION OF THE INVENTION

Figure 1:
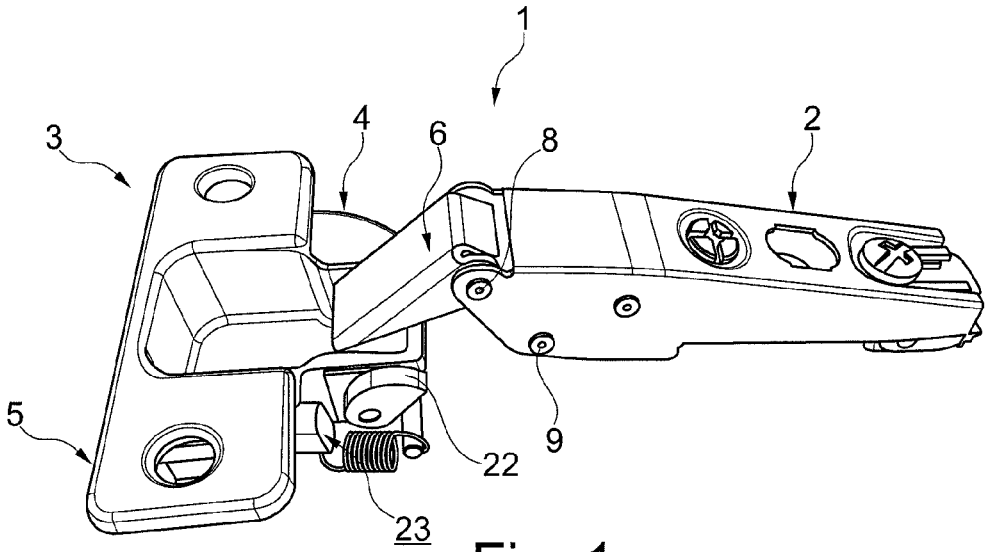
FIGS. 1-4 each show in a perspective view, and in different positions (except for FIGS. 1 and 2 which show an open position), a first variant of a hinge according to the present invention.
Figure 2:
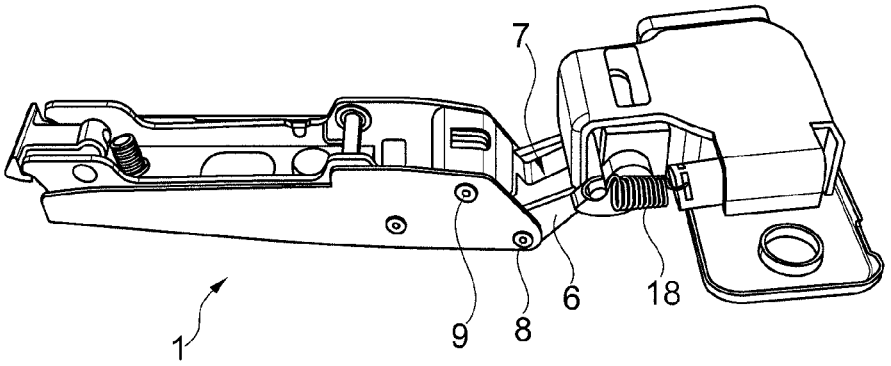
Figure 3:
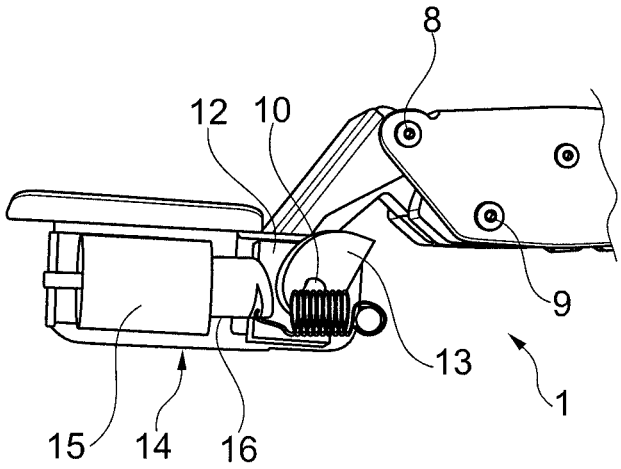
Figure 4:
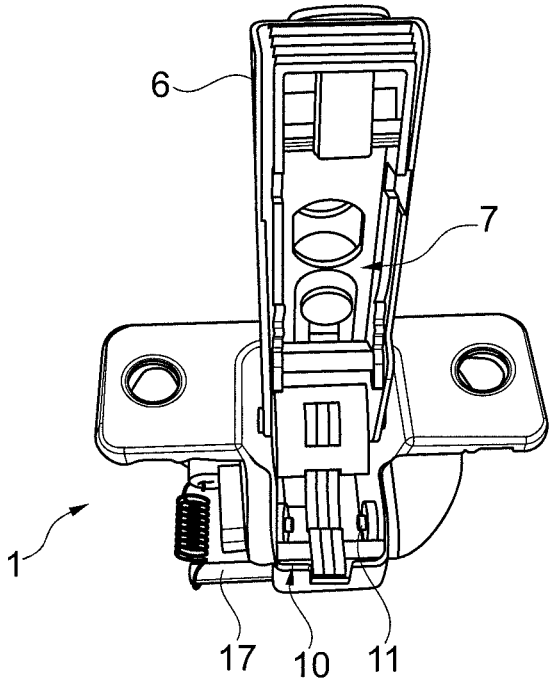

A hinge 1 according to the present invention comprises an attachment element, which is formed as hinge arm 2, a further attachment element, which is formed as housing 3, consisting of a hinge cup 4, and a panel element 5 arranged on the hinge cup 4, and articulated levers 6, 7 which form parts of a four-bar linkage and connect the hinge arm 2 and the housing 3 in an articulated manner via bearing elements 8-11 (FIGS. 1-4).

On an outer face 12 of the housing 3, in particular, of the hinge cup 4, an eccentric member 13 is arranged on the extended bearing element 10. The eccentric member 13 is connected rigidly to the bearing element 10, particularly in a rotationally fixed manner. The bearing element 10 is preferably configured as a shaft and is mounted rotatably on the hinge cup 4. Moreover, the bearing element 10 is connected to the articulated lever 6 in a rotationally fixed manner.

The bearing element 11 is configured, for example, as a bolt or shaft and is pinned in a rotationally fixed manner to the hinge cup 4. The articulated lever 7 is mounted rotatably on the bearing element 11.

Moreover, a damping element 14 comprising a housing 15 and a damper ram 16 is formed on the outer face 12 of the housing. The damping element 14 is advantageously configured as an oil damper.

A holding member 17 in the form of a pin can be arranged fixedly on the outer face 12 of the housing 3. The holding member 17 is connected to the damper ram 16 of the damping element 14 by a spring 18.

The hinge arm 2 of the hinge 1 can be pivoted from an open position of the hinge 1 (FIGS. 1 and 2) via an intermediate position (FIG. 3) to a closed position (FIG. 4) and/or vice versa.

In the open position, the eccentric member 13 and the damper ram 16 of the damping element 14 are not in contact with each other; in particular, the two are not coupled to each other. The spring 18 is untensioned, or is at least under comparatively slight pretensioning, and the damping element 14 is situated in a pretensioned state.

Figure 9:
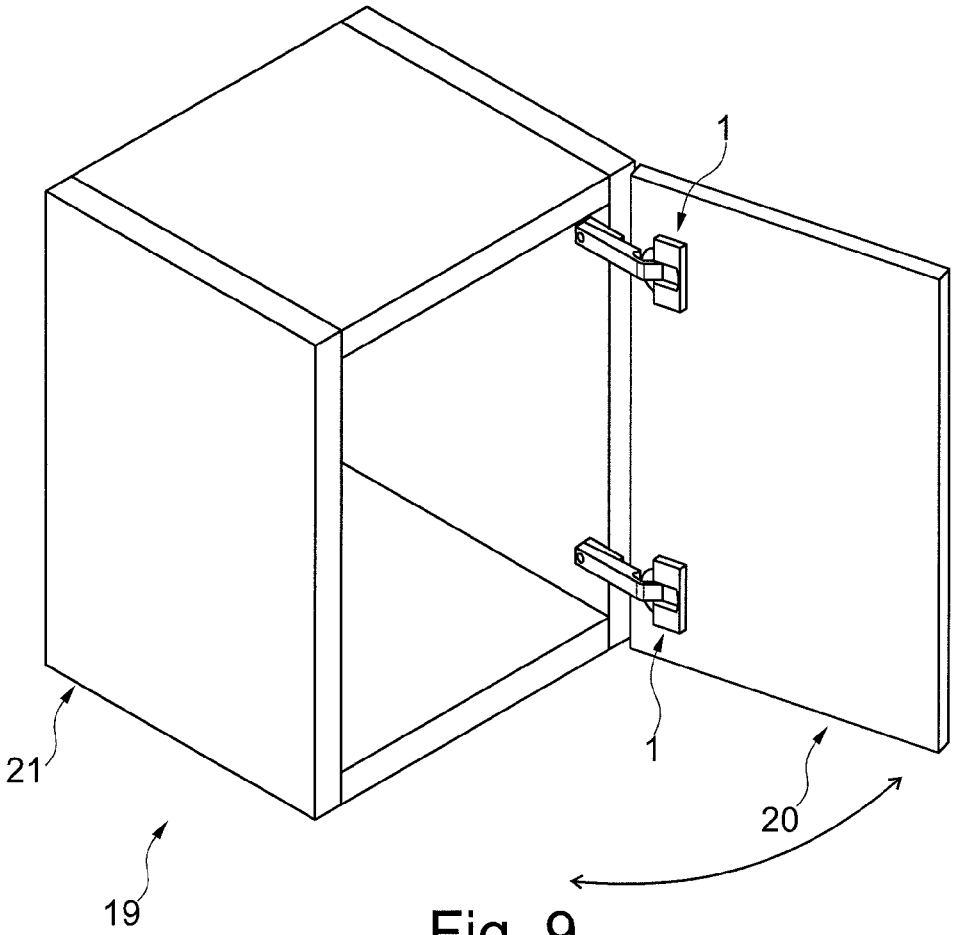
FIG. 9 shows a perspective view of an item of furniture with two hinges, in an open position of a furniture door.
Figure 10:
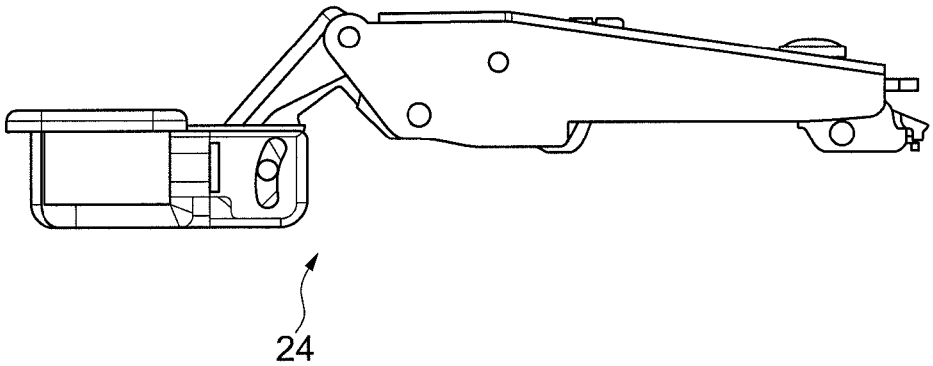
FIG. 10 shows a side view of the hinge from FIG. 5 in an open position.
Figure 11:
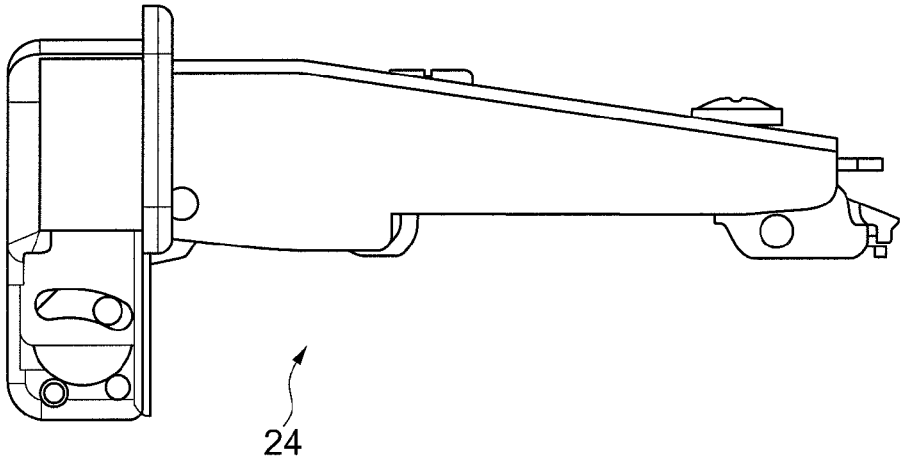
FIG. 11 shows a side view of the hinge from FIG. 5 in a closed position.
Figure 12:
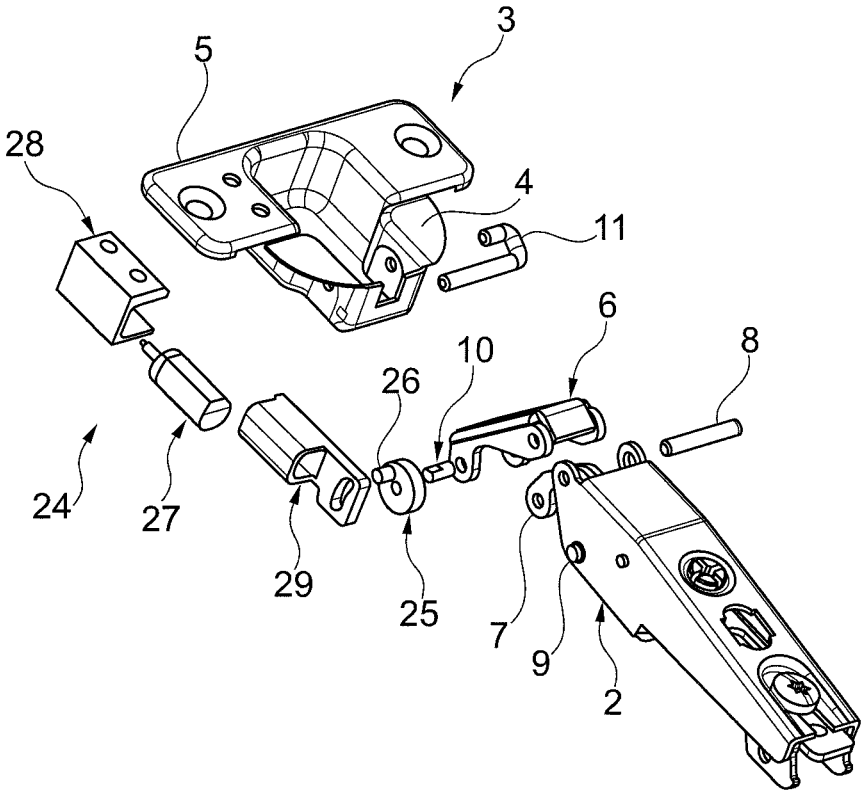
FIG. 12 shows a perspective view of the hinge from FIG. 5 in an exploded representation.

The two identical hinges 1 are mounted on an item of furniture 19, connecting the furniture door 20 to the furniture body 21 in an articulated manner (FIG. 9). When a user closes the furniture door 20 on the item of furniture 19, the hinge 1 is also moved from the open position to the closed position via the intermediate position.

The eccentric member 13 has, in a side view, a droplet-shaped contour, for example. A partial area of the droplet-shaped contour is an outer edge of an eccentrically acting surface 22 of the eccentric member 13. The partial area can be circular or elliptic in outline or have another curved shape.

The eccentric member 13 is arranged on the bearing element 10 in such a way that a rotation of the bearing element 10 and therefore of the eccentric element 13, in particular, during a closing movement of the hinge 1, brings the surface 22 e.g. in the area of the intermediate position of the hinge 1 in contact with a pressing surface 23 of the damper ram 16. Once the contact is made, the eccentric element 13 exerts through the surface 22 a pressing force on the damper ram 16 during the further closing movement. In this way, the rotation movement of the bearing element 10 is converted into a linear movement of the damper ram 16.

On account of the damping, elastic and/or resilient configuration of the damping member 14, the damper ram 16 counteracts the pressing force of the eccentric member 13 with an oppositely directed and advantageously lesser force. In this way, the closing movement of the hinge 1 is damped, and therefore, for example, also the closing movement of the furniture door 20.

In the closing movement of the hinge 1, the spring 18 is tensioned by the movement of the damping member 14. In this way, the spring 18 additionally counteracts the closing movement of the hinge 1 and therefore, for example, also the closing movement of the furniture door 20 with an advantageous damping action.

Advantageously, during opening of the hinge 1, the spring 18 supports a relaxation of the damping element 14 by a tensile force which, for example, is directed counter to the direction of the pressing force on the damper ram 16. In this way, the damper ram 16 of the damping element 14 returns comparatively more quickly to a starting position for a renewed closing operation.

Figure 5:
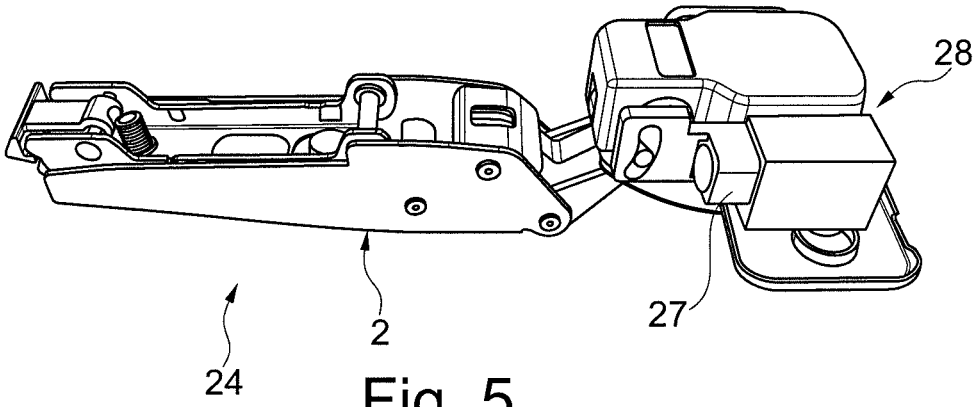
FIGS. 5-6 each show in a perspective view, in an open position, a second variant of a hinge according to the present invention, the hinge being shown only partially in FIG. 6.
Figure 6:
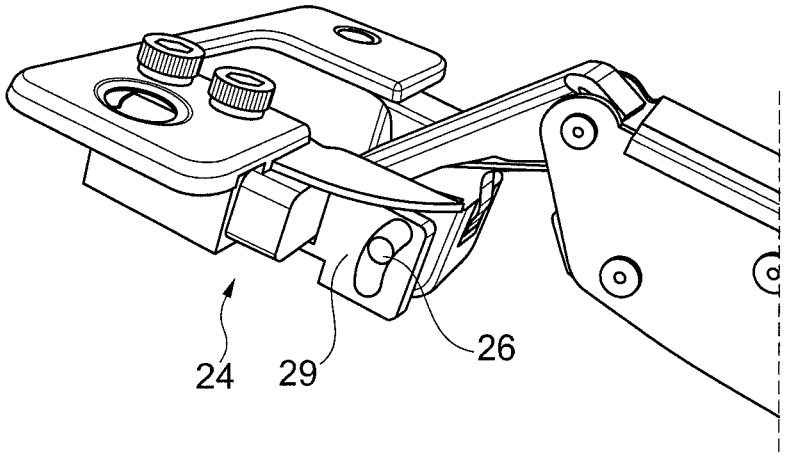
Figure 7:
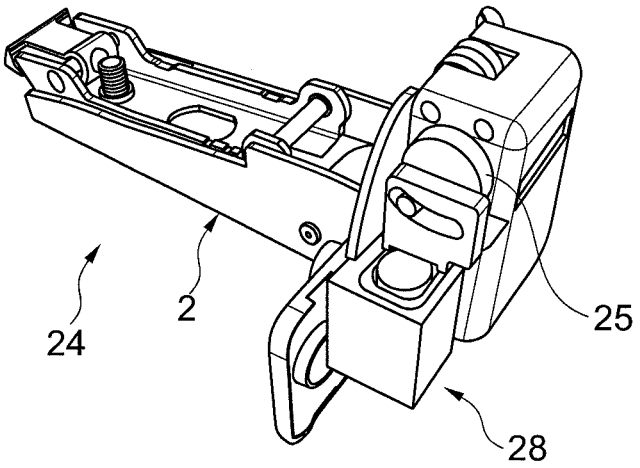
FIGS. 7-8 each show the hinge from FIG. 5 in a perspective view in a closed position, the hinge being shown only partially in FIG. 8.

In a further variant of a hinge 24, a pin-shaped control member 26 is arranged eccentrically on a further eccentric disk 25, which is arranged on the bearing element 10. The control member 26 is arranged, for example, at a distance from a rotation axis of the bearing element 10 on the eccentric disk 25. In this way, during a rotation of the eccentric disk 25 about a rotation axis of the bearing element 10 configured as a shaft, the control member 26 moves in a circular path about the rotation axis (FIGS. 5-7).

Figure 8:
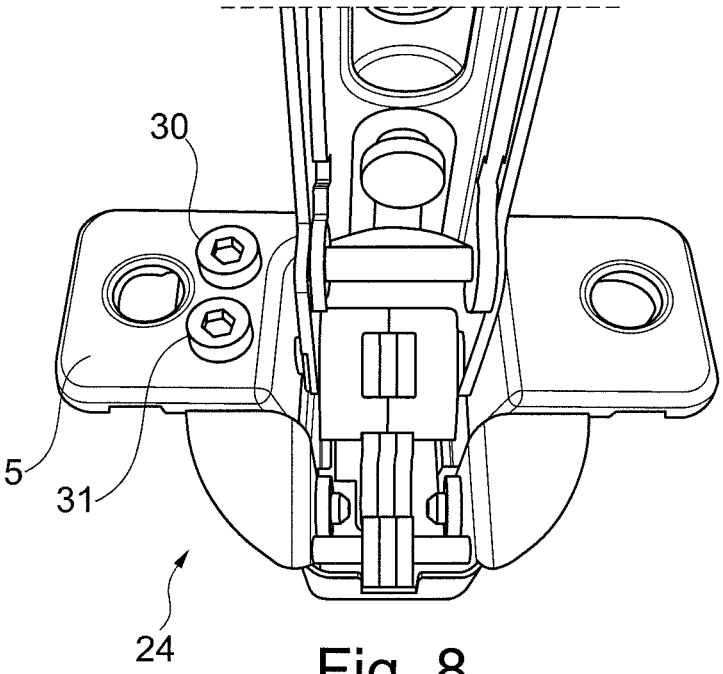

A guide element 29 in the form of a plate with a banana-shaped inner contour or with a curved oblong hole is arranged on a damper ram 27 of a damping element 28 of the hinge 24. The control member 26 is guided in the inner contour of the guide element 29. Moreover, the damping element 28 is secured by screws 30, 31 on the underside of the panel element 5 so as to be concealed from a user when the hinge 24 is in the assembled state on the item of furniture 19 (FIG. 8).

By virtue of the, for example, at least partial circular movement of the control member 26 in an opening or closing movement of the hinge 24 and the advantageous configuration of the inner contour of the guide element 29, the control member 26 can be coupled to the guide element 29 in such a way that a rotation movement or pivoting movement of the hinge arm 2 of the hinge 24 is converted into a linear movement of the damping element 28. In this way, an opening and/or closing movement of the hinge 24 is advantageously damped.

LIST OF REFERENCE SIGNS

1, 24 hinge
2 hinge arm
3 housing
4 hinge cup
5 panel element
6-7 articulated lever
8-11 bearing element
12 outer face
13 eccentric member
14, 28 damping element
15 housing
16, 27 damper ram
17 holding member
18 spring
19 item of furniture
20 furniture door
21 furniture body
22 surface
23 pressing surface
25 eccentric disk
26 control member
29 guide element
30-31 screw element

The invention claimed is:

1. A hinge for a movable furniture part, the hinge being fastened to a body of an item of furniture, the hinge comprising:

a first attachment element;

a second attachment element;

a joint mechanism; and a first bearing element;

wherein the first attachment element is connected pivotably to the second attachment element via the joint mechanism, wherein the joint mechanism comprises at least one articulated lever, which is mounted pivotably on the first attachment element via the first bearing element, and wherein the at least one articulated lever is rotationally fixed on the first bearing element so that a pivoting movement of the at least one articulated lever is translated into a rotational movement of the first bearing element.

2. The hinge according to claim 1, wherein a discrete eccentric member is arranged on the first bearing element, and the discrete eccentric member acts on a damping element.

3. The hinge according to claim 2, wherein the discrete eccentric member is rotationally fixed on the first bearing element.

4. The hinge according to claim 2, wherein the first attachment element comprises a panel element, and the damping element, in the assembled state of the hinge on the item of furniture, is formed on a side face of the panel element of the first attachment element facing toward the body of the item of furniture on which the hinge is fastened.

5. The hinge according to claim 2, wherein the first attachment element comprises a hinge housing, and the discrete eccentric member is arranged on the first bearing element on an outer face of the hinge housing.

6. The hinge according to claim 5, wherein the hinge housing comprises a hinge cup.

7. The hinge according to claim 2, wherein the discrete eccentric member includes a guide member.

8. The hinge according to claim 2, wherein a control member is arranged eccentrically on the discrete eccentric member at a distance from a rotation axis of the first bearing element so that the control member moves in a circular path about the rotation axis when the discrete eccentric member is rotated about the rotation axis.

9. The hinge according to claim 1, wherein the first bearing element is a shaft.

10. The hinge according to claim 1, wherein the damping element comprises a guide element arranged on the damper ram of the damping element.

11. An item of furniture comprising a hinge according to claim 1.

* * * * *